US006868995B2

(12) United States Patent
Hickle et al.

(10) Patent No.: US 6,868,995 B2
(45) Date of Patent: Mar. 22, 2005

(54) SLEEVE PRESSING APPARATUS AND SHOULDER TENSIONING SYSTEM

(75) Inventors: Ernest J. Hickle, New Market, TN (US); Joe Brogan, Dandridge, TN (US); Cleatis Buckner, Dandridge, TN (US)

(73) Assignee: Forenta, LP, Morristown, TN (US)

( * ) Notice: Subject to any disclaimer, the term of this patent is extended or adjusted under 35 U.S.C. 154(b) by 231 days.

(21) Appl. No.: 10/167,364

(22) Filed: Jun. 11, 2002

(65) Prior Publication Data

US 2003/0226864 A1 Dec. 11, 2003

(51) Int. Cl.[7] ..... D06C 15/00
(52) U.S. Cl. ..... 223/57
(58) Field of Search ..... 223/57, 74, 66, 223/67, 72, 73; 38/31, 12

(56) References Cited

U.S. PATENT DOCUMENTS 2,479,729 A * 8/1949 Davis ..... 223/57
2,759,644 A * 8/1956 Forse et al. ..... 223/73
3,471,067 A 10/1969 Stewart
5,148,955 A 9/1992 Cares et al.
5,359,792 A 11/1994 Hanada et al.
5,732,859 A 3/1998 LeBlanc
6,119,379 A 9/2000 Hickle et al.

* cited by examiner

*Primary Examiner*—John J. Calvert
*Assistant Examiner*—James G Smith
(74) *Attorney, Agent, or Firm*—Pitts & Brittian, PC

(57) ABSTRACT

A sleeve pressing apparatus and shoulder tensioning system for removing wrinkles proximal to a shoulder seam of a shirt sleeve. The apparatus includes a means for mounting a pair of sleeves proximal to a working surface. A means for positioning moves the means for mounting and the sleeves to a second position between a pair of pressing members during a pressing operation. The tensioning system includes a means for tensioning each shoulder seam concurrently with the pressing operation. A timing control device extends at least one gripping arm for tensioning each shoulder seam concurrently with the pressing operation for pair of sleeves. A method for pressing a shirt sleeve and concurrently tensioning a sleeve shoulder seam is also disclosed.

20 Claims, 5 Drawing Sheets

SLEEVE PRESSING APPARATUS AND SHOULDER TENSIONING SYSTEM

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a system for pressing garments. More particularly, this invention pertains to a sleeve pressing apparatus and shoulder tensioning system for garments.

2. Description of the Related Art

Numerous machines have been provided for the purpose of steaming, ironing and pressing garments after washing operations. Each prior device typically is configured to allow an article of clothing to be positioned on at least one supporting member such as a vertically oriented buck, which is moved against a pressing surface for the application of pressure from steam heated surfaces, and/or hot air to remove wrinkles from the article of clothing. Typically a shirt, coat, or a pair of pants is positioned on a surface of a buck for a series of sequential pressing operations. The series of sequential operations require positioning and, if necessary, repositioning of the article of clothing by the operator, and further requires a multitude of operating steps before the pressing of the article of clothing is completed. After completion of the operating steps, touch-up ironing by an operator may be required to provide adequate removal of wrinkles along a shoulder seam and/or a back of a shirt. Prior art devices related to pressing garments such as shirts and blouses are disclosed in U.S. Pat. No. 3,471,067, issued to Stewart, on Oct. 7, 1969, and U.S. Pat. No. 5,732,859, issued to LeBlanc, on Mar. 31, 1998.

An improved sleeve pressing apparatus is needed to provide an apparatus for completing a series of coordinated operations including positioning, extending, and pressing of an article of clothing in concert with a shoulder tensioning system for removing wrinkles with minimal positioning of the article of clothing by an operator and minimal touch-up ironing by an operator.

BRIEF SUMMARY OF THE INVENTION

In accordance with the present invention, there is provided a sleeve pressing apparatus and shoulder tensioning system for tensioning the shoulder seams of a shirt to remove wrinkles during drying and pressing operations of an article of clothing such as a shirt. One embodiment of a sleeve pressing apparatus is an apparatus configured to accept thereon any of a variety of sizes of a shirt or a coat having a pair of sleeves and shoulder seams to be pressed. The sleeve pressing apparatus includes a supporting means for extending and positioning each sleeve for drying and pressing of each sleeve in concert with a shoulder tensioning system that provides tensioning means for removing wrinkles from each shoulder seam area of each sleeve. The supporting means of the sleeve pressing apparatus includes a pair of sleeve holders attached to a means for pivoting connected to the cabinet. The sleeve holders are disposed in a first position in a substantially parallel and spaced apart orientation extended above a mounting shelf for positioning the sleeves of a shirt on each respective sleeve holder. The pair of sleeve holders are positioned by pivoting to a second position in which each shirt sleeve is disposed between a pair of elongated pressing members for drying and pressing of the shirt sleeves.

A shoulder tensioning system is positioned within the sleeve pressing apparatus and includes a first and a second grip arm disposed to be extendable from respective first and second pistons concurrent with the operation of the sleeve pressing apparatus. Each grip arm includes a gripping end that is extendable against each sleeve shoulder seam concurrently with actuation of the pressing members of the sleeve pressing apparatus. A timing control device provides proper timing for extension of each gripping end to maintain tension against each sleeve shoulder seam concurrently during the sleeve pressing operation. Wrinkles in the shoulder seam area of each sleeve are concurrently removed by the shoulder tensioning system without an operator having to reposition either shirt sleeve for removal of wrinkles during operation of the sleeve pressing apparatus.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 3:
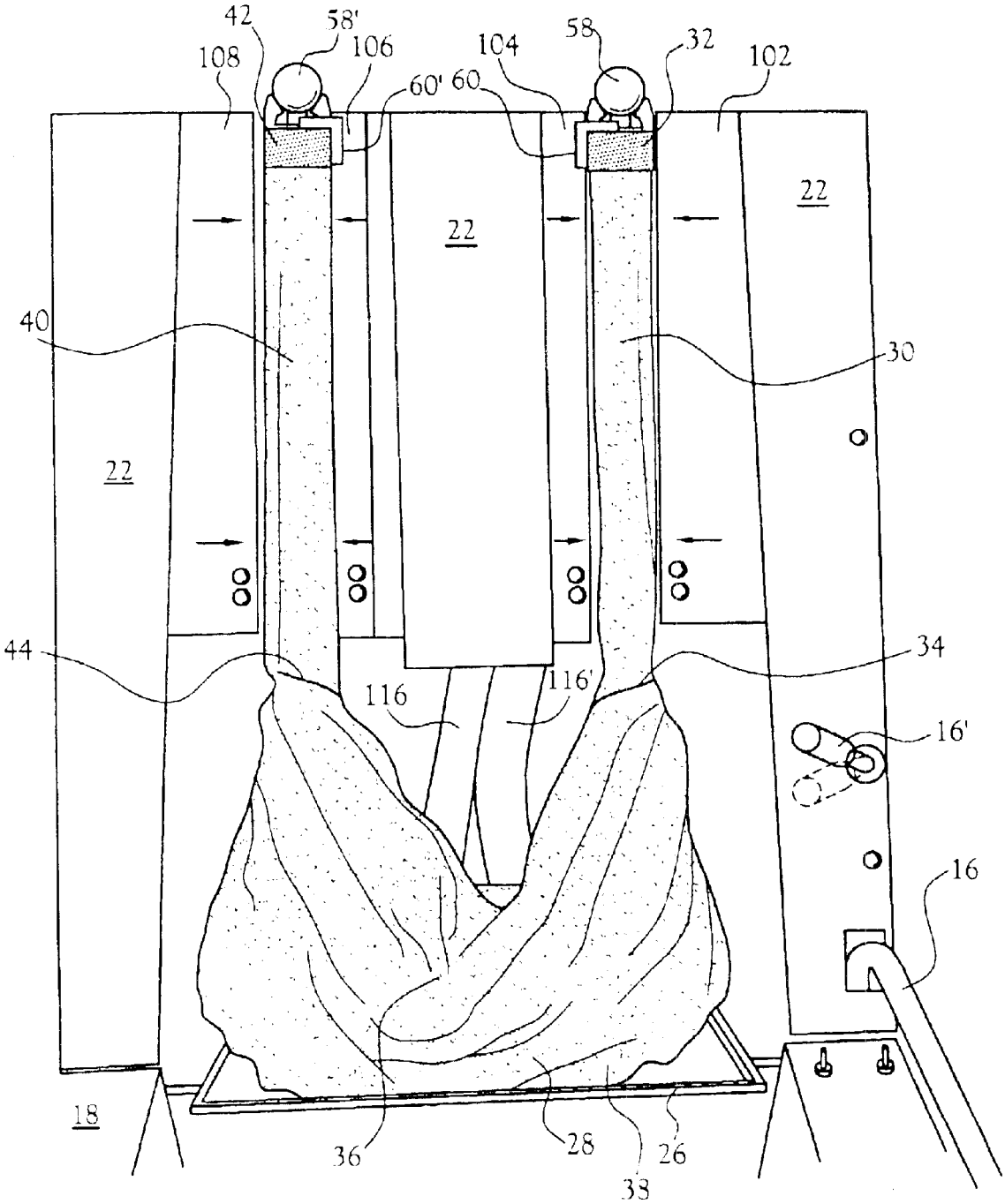
FIG. 3 is an exploded front view of the upper portion of the cabinet of FIG. 1, illustrating shirt sleeves mounted on each first and second sleeve holder positioned between respective pressing members in preparation of pressing operations.
Figure 4:
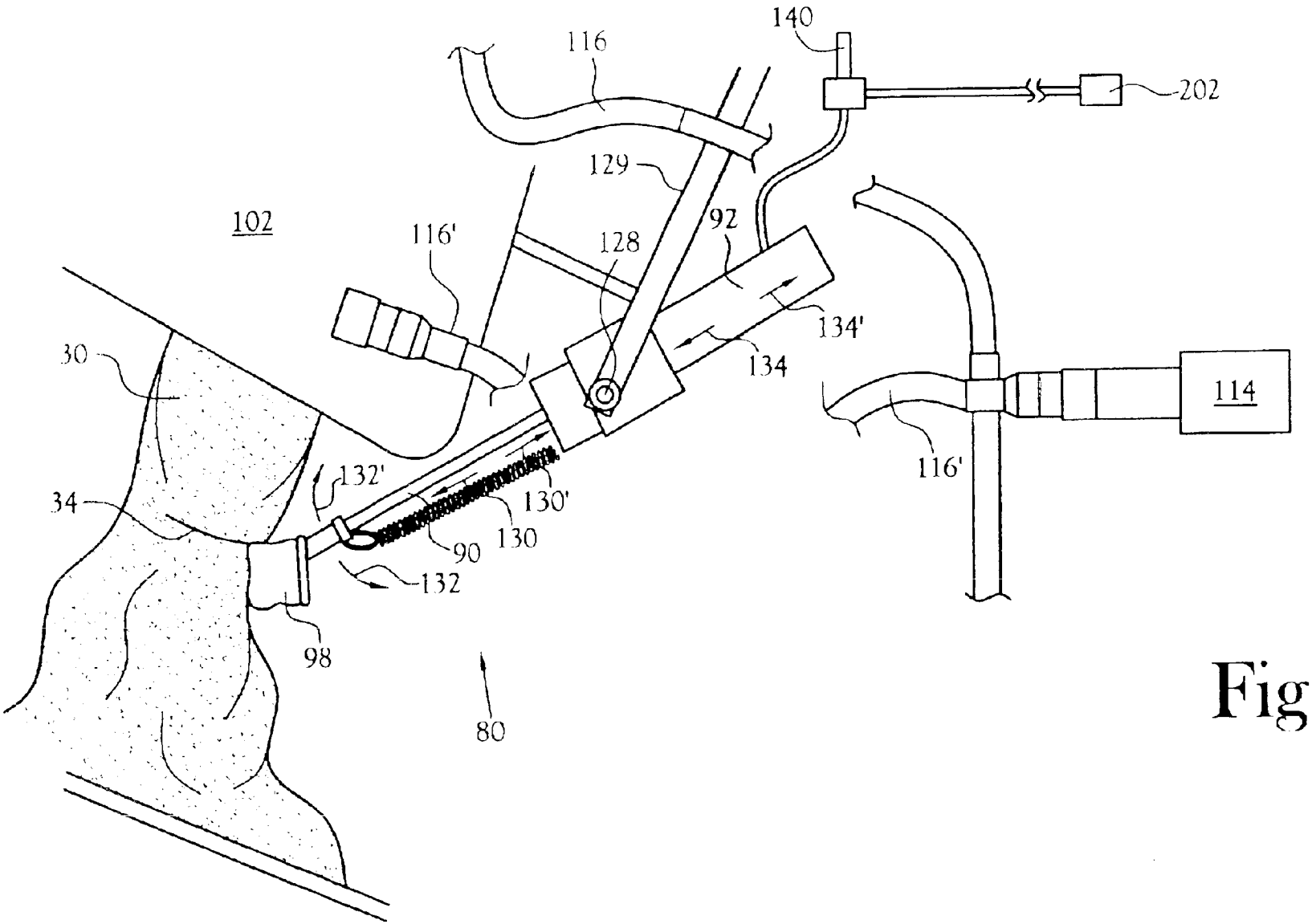
FIG. 4 is an exploded side view of the cabinet interior of FIG. 2, illustrating a shoulder seam tensioning system of the present invention, with the shoulder seam maintained under tension by each one of a pair of gripping arms extended in concert with pressing operations of the sleeve pressing apparatus.
Figure 5:
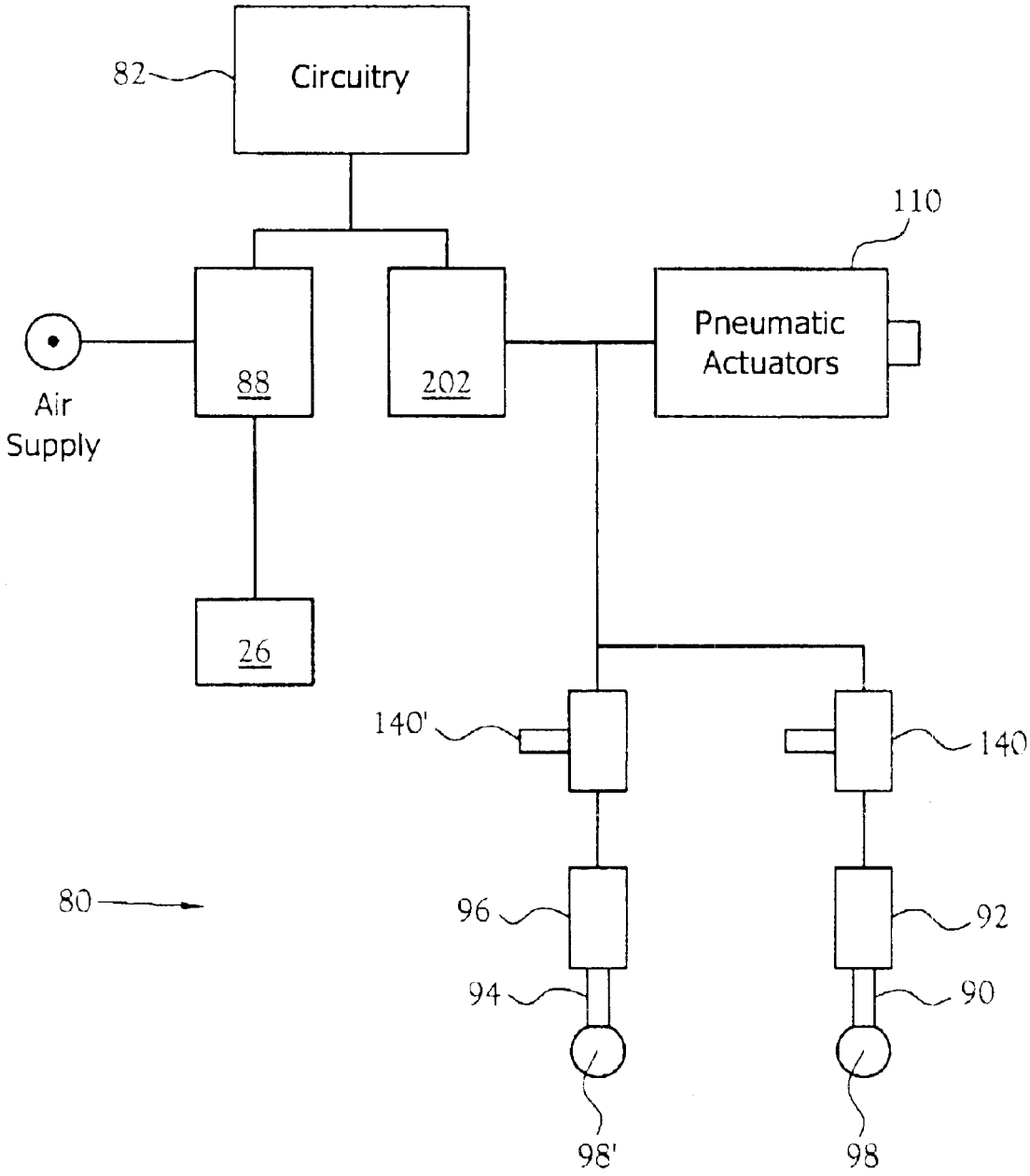
FIG. 5 is a schematic of the shoulder seam tensioning system for the extension of each one of a pair of gripping arms during pressing operations of the pressing apparatus.

A sleeve pressing apparatus and shoulder tensioning system is disclosed for tensioning the shoulder seams to remove wrinkles of a shirt during drying and pressing operations. A sleeve pressing apparatus 10 is illustrated generally in FIGS. 1 and 2, and a shoulder tensioning system 80 is illustrated in FIGS. 4 and 5. The sleeve pressing apparatus 10 includes a front cabinet 12 and a support frame 14 that form a frame having a base for support of the sleeve pressing apparatus above a supporting surface such as a floor. The front cabinet 12 includes multiple mechanical controls 16 including at least one handle and additional adjusting means for control that are generally positioned on, or above, the front surface 18 of the front cabinet 12, and foot pedals 20 that provide additional control measures for an operator of the sleeve pressing apparatus 10. The front cabinet 12 is connected by the support frame 14 to a generally upright upper support frame 22, and a generally horizontal working surface 24. The upper support frame 22 may be angled from a vertical orientation to easier pressing of sleeves when shirt sleeves 30, 40 are positioned before tensioning, drying and pressing operations. The working surface 24 includes a pivotable and height-adjustable shelf 26 that is tilted to a second position 66 by movement of the shelf support member 26' (see FIG. 2) toward the upper support frame 22 when a shirt 28 and shirt sleeves 30, 40 are positioned above the shelf 26 (see FIG. 3).

Figure 1:
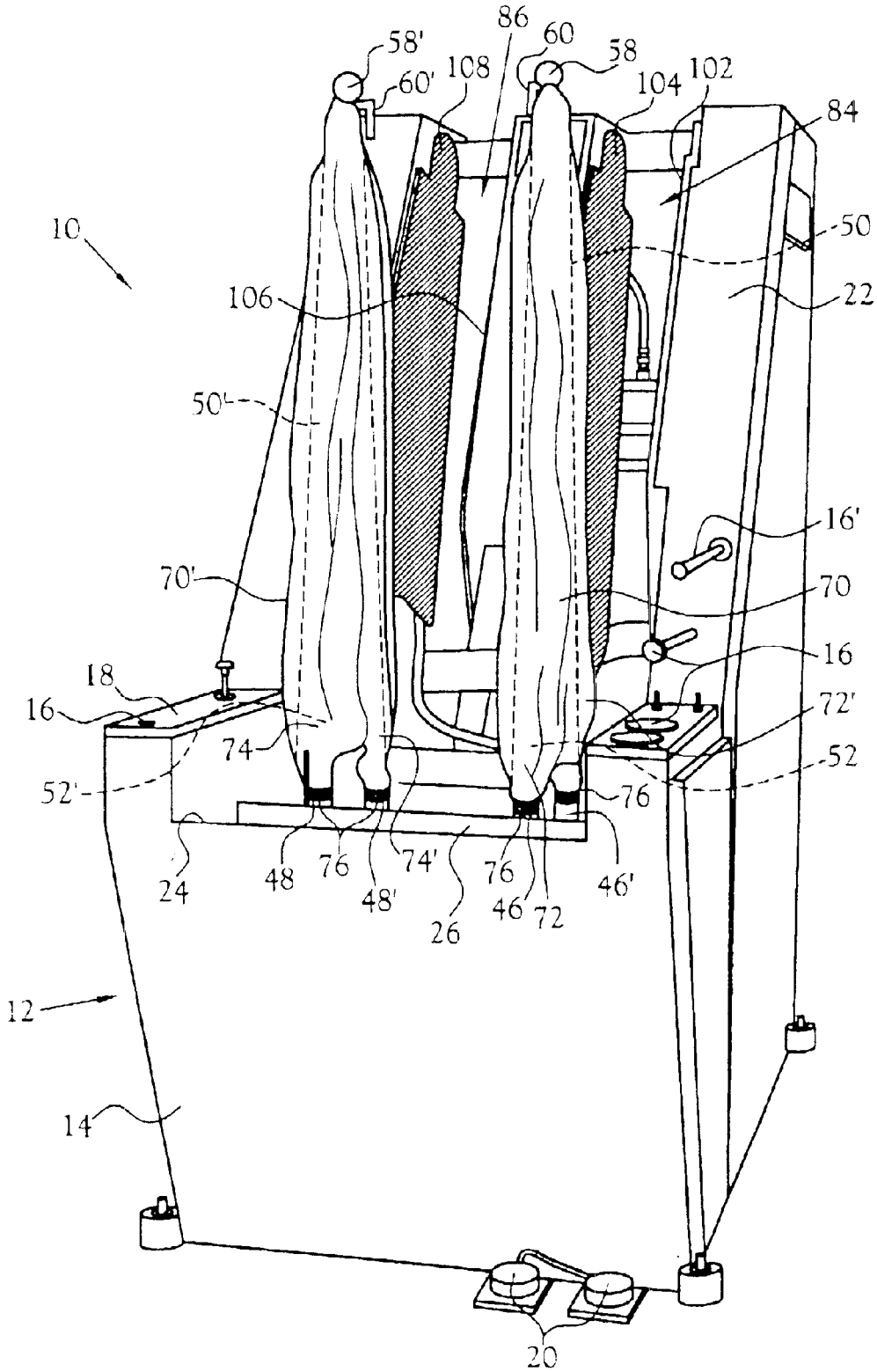
FIG. 1 is a perspective view of a sleeve pressing apparatus including a pressing cabinet for support of a shirt for removal of wrinkles from the sleeves of the shirt.

One embodiment of the sleeve pressing apparatus 10 includes the height-adjustable shelf 26 having means for mounting the sleeves 30, 40 of a shirt thereon, such as a first sleeve holder 50 attached at first holder base end 52 (see FIG. 2), with a air bag 70 mounted thereon (see FIG. 1). A second sleeve holder 50' (shown in phantom in FIG. 1), and second holder base end 52' (shown in phantom in FIG. 1) are positioned adjacent to first sleeve holder 50, with a second air bag 70' positioned on the second sleeve holder 50' (see FIG. 1). Each sleeve holder 50, 50' is attached to the shelf 26 at a respective base end 52, 52' that is positioned proximal to respective openings 46, 48 through the shelf 26. Each sleeve holder 50, 50' is disposed to extend upwards with the shelf 26 in substantially parallel and spaced apart orientation. Air is delivered to each air bag 70, 70' for drying of each shirt sleeve 30, 40 through each base of each elongated air bag 70, 70' that is releasably connected to openings 46, 48. One embodiment provides air bags 70, 70' composed of a material that is not permeable to air. An alternate embodiment of the air bags 70, 70' (not shown) may be composed of a material that is permeable to moisture and air. Each elongated air bag 70, 70' is independently removable from each first and second sleeve holder 50, 50' when either air bag 70, 70' is soiled or torn from use.

An alternative embodiment for the air bags 70, 70' includes a front air chamber 72, 74 and a rear air chamber 72', 74', each chamber having a base end opening that is separately connectable by adjustable hose clamps 76 to each respective opening 46, 46', 48, 48' through the shelf 26. Heated air is blown upwards through each air bag 70, 70' as supplied through respective opening 46, 46', 48, 48' by air ducts 122 through a heated transfer device 112 known to those skilled in the art, by a transfer means such as an air blower device 120 (see FIG. 2). The front air chambers 72, 74 and rear air chambers 72', 74' (see FIG. 1) may be composed of a porous material that allows pressurized air to pass through front and rear portions of each air chamber. An alternate configuration of air chambers 72, 72', 74, 74' may be composed of non-porous material.

The upper end of each air bag 70, 70' is attachable to respective distal ends 54, 54' of sleeve holders 50, 50' with a means for connecting 58, 58' such as a T-clamp 60, 60' for each sleeve end that includes a lever clamp that is manipulated down onto each shirt sleeve end. Alternative sleeve clamps for securing the shirt sleeve ends may be utilized as known to those skilled in the art. Each sleeve holder 50, 50' is adjustable in height 56 to numerous lengths for support of a plurality of lengths of shirt sleeves 30, 40.

Each sleeve holder 50, 50' is sized to accept thereon each respective sleeve 30, 40 of a shirt 28 or coat when each sleeve holder 50, 50' is moved 64 to the first, upright position with the sleeve holders 50, 50' in a generally vertical plane and the shelf 26 oriented in a generally horizontal plane. Each open sleeve end 32, 42 of each sleeve 30, 40 is clamped by the respective T-clamps 60, 60' to maintain each sleeve 30, 40 in an extended position. The shoulder seam 34, 44 of each sleeve 30, 40 is positioned proximate to each respective sleeve holder base 52, 52'. The shirt back portion 36 and shirt tail 38 remain loosely draped on shelf 26 during each pressing operation (see FIG. 3).

Figure 2:
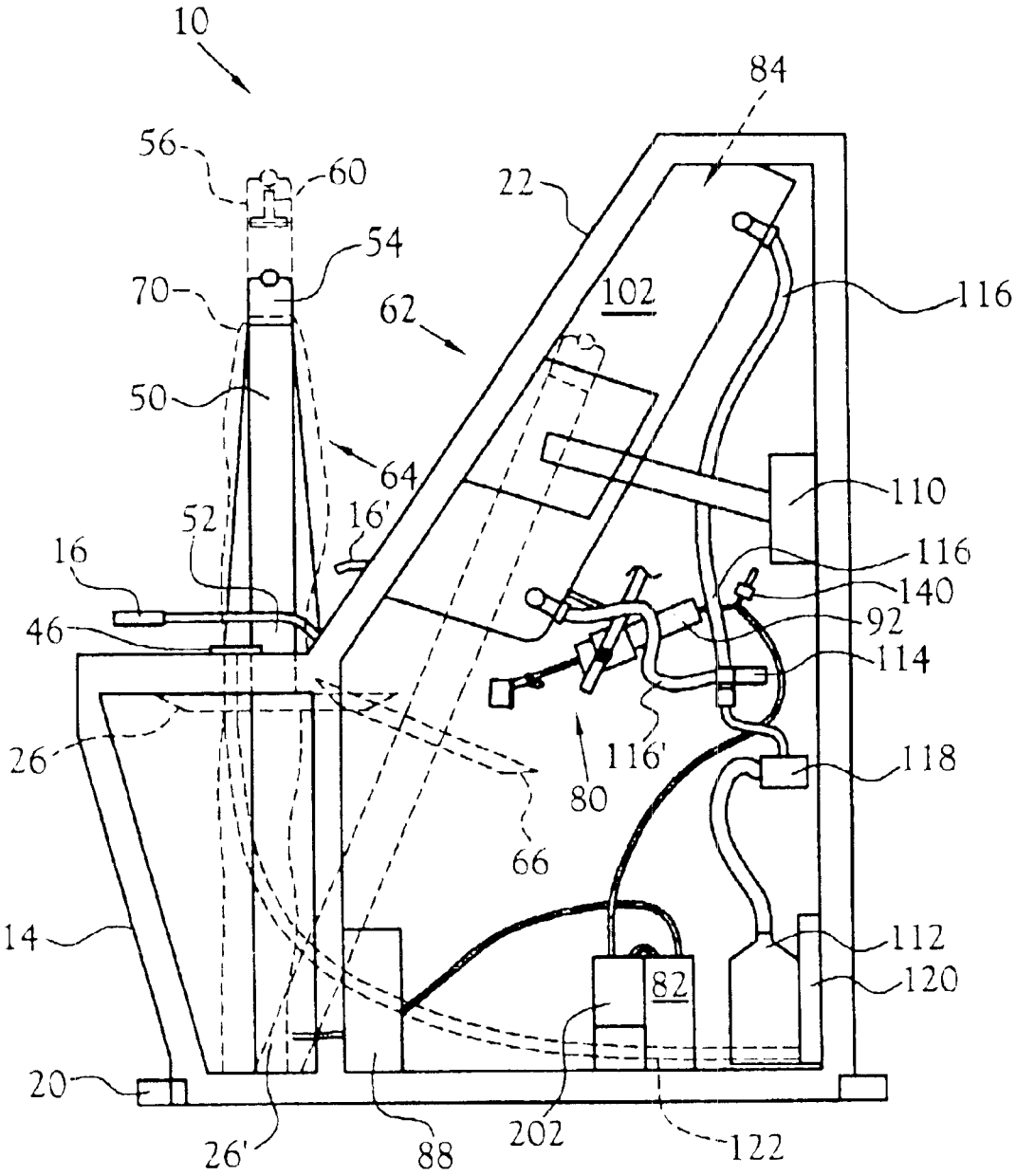
FIG. 2 is a side view of a cabinet of the sleeve pressing apparatus of FIG. 1, illustrating one of two sleeve holders in an upright position and a shoulder tensioning system in a retracted position disposed within the pressing cabinet.

The shelf 26 includes a pneumatic adjusting means for tilting and adjusting the height of shelf 26 to a raised height 56 (see FIG. 2). The pneumatic adjusting means for tilting and height adjusting includes a means for pivoting 88 that utilizes a plurality of pistons illustrated generally as the means for pivoting 88 in FIG. 2, with the pistons connected to the shelf support member 26', for pivoting and tilting movement inwardly 62 of each sleeve holder 50, 50' from a first, upright position to a second, tilted position 66. In the second position, the shelf 26 and sleeve holders 50, 50' are tilted at an angle of about 30 degrees to about 60 degrees from a vertical position for positioning sleeve holders 50, 50' respectively into a first open channel 84 and a second open channel 86. Each channel 84, 86 is sized in width and length to receive therein the respective first sleeve holder 50 and second sleeve holder 50'. The mechanical controls 16 are manipulated by the operator to adjust the height of the shelf 26 by controlling a combination of pneumatic powered pistons that provide height adjustments and pivoting adjustments for the shelf 26.

Each first and second open channel 84, 86 is bounded by a pair of pressing enclosures such as a movable pair of pressing heads aligned in spaced apart and parallel configuration to define the width and length of the first and second open channel 84, 86. First open channel 84 is bounded on the sides by a first pressing means including an outer pressing head 102 and inner pressing head 104. Second open channel 86 is bounded on the sides by a second pressing means including an inner pressing head 106 and outer pressing head 108. The means for pivoting 88 provides pneumatically activated movement of each sleeve holder 50, 50' from an upright position (see FIGS. 1 and 2), to a second position (see FIG. 3) within the first channel 84 and second channel 86 by tilting inwardly 62 of shelf support member 26' to the second position 66 (see FIG. 2, in phantom). Upon positioning of each sleeve holder 50, 50' into each respective channel 84, 86, each pair of pressing heads 102, 104 and 106, 108 are moved by a pair of like-configured pneumatic actuators 110 (see FIG. 2) that include at least one lever arm attached to each pressing head 102, 104 and 106, 108 for movement of each pair of pressing heads 102, 104 and 106, 108 against each sleeve length for heating and pressing. A transfer of steam occurs from a branching connection 118, for delivery of steam by at least one pair of hoses 116, 116' connected to each movable pressing head 102, 104 and 106, 108. The transferred steam provides heat for drying and pressing the sides of each shirt sleeve 30, 40. A like-configured pair of hoses (not shown) are connected to movable pressing heads 106, 108 for transfer of steam. Steam is supplied continually to the movable pressing heads 102, 104, 106, 108 in a pressure range of about 100 psig to about 125 psig. The branching connection 118 may be positioned internal of the support frame 14, or external of the support frame 14, for directing the delivery of steam to pressing heads 102, 104, 106, 108.

The cabinet 12 includes the hand operated controls 16, foot operated controls 20, and light means 16' in communication with a control system 82 to provide an operator with a plurality of control means for adjusting the operation of the sleeve pressing heads 102, 104, 106, 108 and the shoulder tensioning system 80. Upon adjustment of the height of the shelf 26, the shirt sleeves are extended and tensioned with assistance provided by a light means 16' for measuring the length of each sleeve. The light means 16' includes a light emitting device that is directed by the operator toward a seam of the base of at least one sleeve 30, 40, for measuring the position of each sleeve shoulder seam 34, 44 during height adjustment operations for the shelf 26. The hand controls 16 and foot pedal controls 20 are connected with a control system 82 for the coordination of raising and tilting the shelf 26 and closing the sleeve pressing heads 102, 104, 106, 108. The control system 82 includes electrical circuitry known to those skilled in the art for control of a plurality of valves 202, for control of the means for pivoting 88 for pneumatically tilting the shelf support member 26' (see FIG. 2), and for control of pneumatic actuators 110.

A preferred embodiment of a shoulder tensioning system 80 is illustrated in FIGS. 2–5, including a means for tensioning each shoulder seam 34, 44 (see FIGS. 3 and 4), including a first grip arm 90 (see FIG. 4) and an identical second grip arm 94 (see FIG. 5), disposed to extend against an outer clothing surface proximal of respective seams of each respective shoulder seam 34 (see FIG. 4) and 44 (see FIG. 3), after each sleeve 30, 40 and respective sleeve holders 50, 50' are tilted into the sleeve pressing heads 102, 104, 106, 108. The first and second grip arms 90, 94, are extendable from respective pistons 92, 96, which are configured in identical configurations. The following discussion will describe grip arm 90 and piston 92 (see FIG. 4), with similar elements utilized for grip arm 94 and piston 96 (see FIG. 5). Piston 92 is typical of pneumatic powered pistons known to those skilled in the art for extending and retracting a piston rod composing a grip arm 90 that is extendable toward a shirt shoulder seam 34. First grip arm 90 includes a distal end including a gripping end 98 (see FIG. 4), having a replaceable or a non-replaceable pad, that is extendable against the outer clothing surface adjacent of shoulder seam 34 when sleeve 30 and sleeve holder 50 is tilted into position between sleeve pressing heads 102, 104. A depth of extension and an angle of extension of each grip arm 90, 94 is adjustable to limit the depth of extension 130 and resulting retraction 130' of each grip arm 90, 94. Pivoting adjustments 132, 132' of each grip arm 90, 94 are mechanically adjustable at a pivot connection 128 attached with a first bracket 1129 to the first piston 92 (see FIG. 4). A similar pivot connection 128 is attached to a like-configured second bracket (not shown) that is separately connected to the second piston 96 (not shown), but is an identical configuration as illustrated for first piston 92 in FIG. 4. Additional position adjustments in the forward 134 and rearward 134' orientation of piston 92 are possible with mechanical adjustments at pivot connection 128, and/or mechanical adjustments for the positioning of first and second bracket 129.

The timing and rate of extension of each grip arm 90, 94 and each gripping end 98, 98' is controlled by at least one timing control device 140, and preferably two timing control devices 140, 140', in communication with each piston 92, 96 (see FIG. 5), in order to maintain tension against each shoulder seam 34 (see FIG. 4) and 44 (see FIG. 3), concurrently while each sleeve 30, 40 is being pressed within sleeve pressing heads 102, 104, 106, 108. The timing control devices 140, 140' includes circuitry to provide timing coordination of the activation of, and rate of extension 130 of each gripping end 98, 98', against respective shoulder seams 34, 44, during the pneumatic activation of the closing of the sleeve pressing heads 102, 104, 106, 108. Retraction 130' of each gripping end 98, 98' is accomplished by each respective piston 92, 96 at the end of the pressing operation. Each sleeve 30, 40 is dried and pressed with wrinkles removed from each shoulder seam 34, 44. By maintaining each gripping end 98, 98' against each respective shoulder seam 34, 44 during the operation of the sleeve pressing steps, wrinkles are minimized along each shoulder seam 34, 44, therefore eliminating a potential time-consuming step of a separate touch-up of residual wrinkles around the shoulder seams by an operator at a pressing station. An alternate embodiment for the gripping ends 98, 98' includes a configuration (not shown) to allow each gripping end 98, 98' to be swivelled inwardly from a position adjacent to each respective shoulder seam 34, 44 by respective pistons 92, 96, for placement of each gripping end 98, 98' against respective shoulder seams 34, 44.

A method of operation for the sleeve pressing apparatus 10 and shoulder tensioning system 80 is disclosed including a step of providing a pneumatically operated apparatus having a means for mounting including at least two sleeve holders 50, 50' supported above a support shelf 26, with the sleeve holders 50, 50' sized to support in a first position the sleeves of an article of clothing such as a shirt. A step of mounting includes mounting each sleeve of a shirt on the at least two sleeve holders 50, 50' with each sleeve having a shoulder seam positioned proximal to the support shelf 26. A step of raising includes raising each sleeve mounted on the at least two sleeve holders 50 to an extended upright position above the support shelf 26. A step of rotating tilts 62 each sleeve mounted on the at least two sleeve holders 50, 50' to a second position 66 in the sleeve pressing apparatus 10 by a means for positioning 88 the support shelf 26 and the at least two sleeve holders 50, 50' to a second position 66. A step of pressing includes applying heat by a pair of pressing heads along each side of each sleeve mounted on the at least two sleeve holders 50, 50' while each sleeve is enclosed within the sleeve pressing apparatus 10.

Concurrent with the step of pressing, a step of tensioning occurs, including tensioning each shoulder seam by extending a means for tensioning of a shoulder tensioning system 80 against each shoulder seam 34, 44. The timing of the extending step is controlled by timing control devices 140, 140' having circuitry to provide timing coordination of the activation of, and rate of extension 130 of each gripping end 98, 98' of the means for tensioning against respective shoulder seams 34, 44, during the step of pressing. A step of retracting includes moving the means for tensioning from against each shoulder seam 34, 44. A step of repositioning includes positioning the at least two sleeve holders 50 from the second position to the first, upright position after the steps of pressing each sleeve and tensioning each shoulder seam are completed. An operator controls the steps of mounting, positioning, and pivoting each sleeve into the sleeve pressing apparatus 10. The step of tensioning occurs concurrently with the step of pressing, as monitored by the circuitry of the control system 82 and timing control devices 140, 140', and provides substantially wrinkle-free shoulder seams for each sleeve of an article of clothing without the operator having to touch-up the shoulder seam areas by a separate pressing operation, therefore eliminating a potentially time-consuming step for each shoulder seam.

From the foregoing description, it will be recognized by those skilled in the art that a sleeve pressing apparatus and shoulder seam tensioning system for pressing an article of clothing is provided that provides an apparatus capable of accomplishing a plurality of pressing operations including pressing and drying of the sleeve surfaces, and a tensioning system capable of tensioning and producing wrinkle-free shoulder seam areas of a shirt or a similar article of clothing.

While the present invention has been illustrated by description of several embodiments and while the illustrative embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicants' general inventive concept.

Having thus described the aforementioned invention, we claim:

1. A tensioning apparatus for tensioning a shoulder seam of at least one sleeve of an article of clothing during a pressing operation for at least one sleeve, comprising:

means for mounting at least one sleeve of an article of clothing proximal to a working surface, said means for mounting supporting at least one sleeve in a first position extended above said working surface;

means for positioning said working surface from said first position to a second position, with said at least one sleeve being supported by said means for mounting when said working surface is in said second position during the pressing operation for at least one sleeve;

means for tensioning the shoulder seam of at least one sleeve when mounted on said working surface, said means for tensioning is extended against an outer clothing surface proximal of the shoulder seam when said working surface is in said second position concurrent with the pressing operation for at least one sleeve, said means for tensioning including:

a piston positioned proximal of each respective outer clothing surface proximal to each respective shoulder seam, said piston having a piston rod having a pair of grip arms extendable against each respective outer clothing surface proximal of respective shoulder seams of either sleeve, each grip arm having a distal end extendable against and retractable from each respective outer clothing surface proximal of each shoulder seam when said means for mounting is positioned to said second position; and a timing control device for control of a rate of extension of each grip arm and distal end, said timing control device in communication with said piston for maintaining tension against each respective outer clothing surface proximal of each respective shoulder seam during actuation of the pressing operation for at least one sleeve while in said second position.

2. The tensioning apparatus of claim 1 further comprising means for control of the pressing operation, said means for control is manipulated by an operator for movement of said means for mounting and said working surface having said at least one sleeve disposed thereon to said second position for tensioning of the shoulder seam by said means for tensioning concurrent with the pressing operation.

3. The tensioning apparatus of claim 2 wherein said means for mounting includes said working surface having a first and a second sleeve holder attached thereon, said first and second sleeve holder being in substantially parallel orientation and being adjustable in height to accept thereon respective right and left sleeves of the article of clothing, each first and second sleeve holder having a means for clamping a distal end of each sleeve for removably securing right and left sleeves on respective distal ends of said first and second sleeve holder, said first and second sleeve holder positions the shoulder seam of each sleeve proximal to said working surface.

4. The tensioning apparatus of claim 3 wherein said means for tensioning includes a pair of pistons, each piston having a grip arm extendable against respective shoulder seams of the right and left sleeves, each grip arm having a distal end extendable against and retractable from each respective shoulder seam when said means for mounting is positioned to said second position.

5. The tensioning apparatus of claim 4 wherein said means for tensioning further includes said timing control device for control of said rate of extension of each grip arm and distal end, said timing control device in communication with each piston for maintaining tension against each respective shoulder seam during actuation of the pressing operation for each sleeve while in said second position.

6. The tensioning apparatus of claim 5 wherein the pressing operation including:

a frame for support of said working surface and the pressing operation;

a shelf pivotably connected to support said first and second sleeve holder above the frame, said shelf and said first and second sleeve holder disposed to be pivoted to said second position tilted relative to said working surface and toward said frame; and a first pair and a second pair of pressing members in spaced apart orientation on said frame, each of said first pair and second pair of pressing members are aligned to accept respectively said first and second sleeve holder between each pair of pressing members when said first and second sleeve holder are pivoted in said second position; and means for adjustment of a height of said shelf and said first and second sleeve holder, said means for adjustment raises and lowers said shelf and said first and second sleeve holder in a substantially vertical plane, said means for adjustment further including a pivot means for pivoting said first and second sleeve holder into said second position disposed between respective first pair and a second pair of pressing members.

7. The tensioning apparatus of claim 6 wherein said first and second pairs of pressing members are positioned in aligned orientation, each pair of pressing members extendable against respective sleeves when said first and second sleeve holder is pivoted into said second position between said first and second pairs of pressing members.

8. A sleeve pressing and shoulder tensioning system for removing wrinkles from a shoulder seam of an article of clothing during a pressing operation for each sleeve, comprising:

a mounting shelf for support of a first and a second sleeve holder attached in aligned and spaced apart orientation above said mounting shelf, said first and second sleeve holder being in substantially parallel orientation and having respective base ends attached to said mounting shelf, said first and second sleeve holder supports a right and left sleeve of a shirt above said mounting shelf, said first and second sleeve holder having a clamp for gripping each sleeve against respective distal ends of said first and second sleeve holder;

said right and left sleeve having respective shoulder seams disposed proximal to said respective sleeve holder base ends, said mounting shelf pivotable between a first position of a substantially vertical orientation, to a second position having said first and second sleeve holder angled from the substantially vertical position;

a means for tensioning the shoulder seam of each of the right and left sleeve when positioned on said first and second sleeve holder, said means for tensioning including a first and a second grip arm attached within said cabinet, said first and second grip arm having an end extendable against a shoulder seam of each right and left sleeve positioned proximal to said respective base ends of said first and second sleeve holder;

a first and second pair of pressing members positioned in spaced apart orientation and aligned to accept said first and second sleeve holder when said mounting shelf is pivoted to said second position; and a means for movement of said mounting shelf from said first position to said second position, whereby each right and left sleeve on said first and second sleeve holders are positioned between respective first and second pair of pressing members;

whereby said means for tensioning maintains each right and left shoulder seam in tension when positioned in said second position during concurrent pressing of each sleeve by said first and second pair of pressing members.

9. The sleeve pressing and shoulder tensioning system of claim 8 said means for tensioning includes:

a pair of pistons positioned proximal to each respective shoulder seam, each piston having a piston rod having a grip arm extendable against respective shoulder seams of the first and second sleeve, each grip arm having a distal end extendable against and retractable from each respective shoulder seam when said means for mounting is positioned to said second position; and a timing control device for control of a rate of extension of each grip arm distal end, said timing control device in communication with each piston for maintaining tension against each respective shoulder seam during actuation of the pressing operation for each sleeve while in said second position.

10. The sleeve pressing and shoulder tensioning system of claim 9 wherein said means for positioning including a pneumatic system for movement of said first and second sleeve holder from said first position being substantially vertical above said working surface, to said second position within said respective first and second channel in said cabinet.

11. The sleeve pressing and shoulder tensioning system of claim 10 wherein said pneumatic system including a means for control of movement of said pivotable working surface and each pair of pressing members, said means for control is manipulated by an operator to control movement of said pivotable working surface to said second position for actuation of the pressing operation.

12. A method for tensioning shoulder seams during pressing of a sleeve of an article of clothing, comprising the steps of:

providing a pneumatically operated system including means for mounting each sleeve in an upright position above a support shelf, and further including a pressing enclosure sized to accept therein said support shelf and said means for mounting;

mounting each sleeve of an article of clothing on said means for mounting, each sleeve having a shoulder seam positioned proximal to said support shelf;

raising each sleeve mounted on said means for mounting to an extended position above said support shelf;

rotating each sleeve mounted on said means for mounting into said pressing enclosure;

tensioning each shoulder seam, said step of tensioning includes extending a means for tensioning positioned exterior of each sleeve for engaging against an outer clothing surface proximal of each shoulder seam when each sleeve is within said pressing enclosure, pressing each side of each sleeve mounted on said means for mounting while each sleeve is within said pressing enclosure, said step of pressing is concurrent with said step of tensioning;

retracting said means for tensioning from against each shoulder seam; and positioning said support shelf, means for mounting and having each sleeve thereon to the upright position after said step of pressing;

whereby said method for tensioning provides substantially wrinkle-free shoulder seams for each sleeve of an article of clothing.

13. The method for tensioning of claim 12 wherein said step of tensioning includes providing a first and second grip arm extendable against the outer clothing surface proximal of each respective shoulder seam, said step of tensioning further includes providing a timing control device for adjusting the speed of extension of each grip arm against each respective shoulder seam of each sleeve during said step of pressing.

14. The method for tensioning of claim 13 wherein said step of retracting includes retracting said first and second grip arm from contact against each respective shoulder seam after said step of pressing is completed.

15. The method for tensioning of claim 14 wherein said step of positioning includes pivoting said means for mounting with each sleeve thereon from within said pressing enclosure to the extended upright position above said support shelf for removal of each sleeve from said means for mounting.

16. In a tensioning system for tensioning a shoulder seam of each sleeve of an article of clothing during a pressing operation for each sleeve and shoulder seam, the pressing operation powered by a source of pneumatic power and including a frame for support of a means for mounting a first and second sleeve of the article of clothing thereon, said means for mounting supports each first and second sleeve in a first position extended above a working surface, and further including means for positioning to a second position of said first and second sleeve mounted on said means for mounting, said first and second sleeve disposed in said second position during the pressing operation for each sleeve and respective shoulder seam, the improvement comprising:

a means for tensioning the shoulder seam of each of the right and left sleeve when positioned on said means for mounting, said means for tensioning including a first and second piston having respective first and second piston rods extendable from said first and second piston, said first and second piston rod having a first and second grip arm end extendable against a shoulder seam of each right and left sleeve positioned to said second position;

said first and second grip arm end is retractable from each respective shoulder seam when said means for mounting is positioned to said first position; and a timing control device for control of a rate of extension of each grip arm end, said timing control device in communication with said first and second piston for maintaining each grim arm end against each respective shoulder seam concurrently during actuation of the pressing operation for each sleeve while in said second position during the pressing operation for each sleeve and respective shoulder seam.

17. In the tensioning system of claim 16, wherein said first piston and said second piston includes respectively a first pivot connection and a second pivot connection between each of said first and second piston and a first and second pivoting bracket disposed to separately connect between said respective first and second pivot connection to the frame, said first and second pivoting brackets provide adjustment for an angle of extension and a depth of extension for each grip arm end for extension against respective shoulder seams of each sleeve when positioned to said second position.

18. A tensioning apparatus for tensioning a shoulder seam of at least one sleeve of an article of clothing during a pressing operation for each sleeve, comprising:

means for mounting at least one sleeve of an article of clothing proximal to a working surface, said means for mounting supporting said at least one sleeve in a first position extending above said working surface;

means for positioning said working surface having said at least one sleeve disposed thereon, said means for positioning moves said means for mounting to a second position, wherein the shoulder seam of said at least one sleeve is tensioned while said means for mounting having said at least one sleeve disposed thereon is positioned in said second position during the pressing operation for said at least one sleeve;

means for tensioning the shoulder seam of said at least one sleeve when mounted on said working surface said means for tensioning is positioned exterior of each sleeve and is extended against an outer clothing surface adjacent to the shoulder seam concurrently with the pressing operation for said at least one sleeve positioned in said second position, said means for tensioning includes at least one piston having a grip arm extendable against the outer clothing surface adjacent of the shoulder seam of said at least one sleeve, said grip arm having a distal end extendable against and retractable from the outer clothing surface adjacent of the shoulder seam of said at least one sleeve when said means for mounting is positioned to said second position during the pressing operation controlled by the operator;

a timing control device for control of a rate of extension of each grip arm and distal end, said timing control device in communication with each piston for maintaining tension against the outer clothing surface adjacent of each respective shoulder seam during actuation of the pressing operation for each sleeve while in said second position, said timing control device activates said rate of extension of each grip arm during the pressing operation and releases each grip arm for retraction after the pressing operation is completed as controlled by the operator; and means for control of the pressing operation, said means for control is manipulated by an operator for movement of said means for mounting and said working surface having said at least one sleeve disposed thereon to said second position for said means for tensioning to remain extended against the outer clothing surface adjacent to the shoulder seam concurrently with the pressing operation for said at least one sleeve.

19. A tensioning apparatus for tensioning each shoulder seam of a first and second sleeve of an article of clothing during actuation of a pressing operation for the sleeves, comprising:

means for mounting a first and second sleeve of an article of clothing in a first position above a working surface;

means for positioning said working surface from said first position to a second position, the first and second sleeves are supported by said means for mounting when said working surface is in said second position during the pressing operation for the sleeves;

means for tensioning a shoulder seam for each first and second sleeve mounted on said working surface, said means for tensioning including first and second gripping members adjustably positioned exterior of each sleeve for concurrent extension against an outer surface proximal of each shoulder seam when said working surface is in said second position during the pressing operation for the sleeves, said first and second gripping members being reciprocatingly extended and retracted by at least one pneumatically extended piston pivotably supported proximal of said working surface when in said second position; and a timing control device for control of a rate of extension of each gripping member against each outer surface proximal of respective shoulder seams, said timing control device in communication with said means for positioning whereby tension is maintained against each outer surface proximal of each shoulder seam during actuation of the pressing operation for the sleeves.

20. A tensioning apparatus applied against each shoulder seam of a first and second sleeve of an article of clothing during a pressing operation of sleeve surfaces, comprising:

means for mounting each of a first and second sleeve of an article of clothing on a working surface from which each sleeve is upwardly extended, said means for mounting positioning respective first and second shoulder seams proximal of said working surface;

means for pressing applied against each sleeve surface of the first and second sleeves supported by said means for mounting, said means for pressing including at least one pair of first and second pressing heads aligned in spaced apart parallel configuration, said at least one pair of first and second pressing heads being movable by a plurality of pneumatic actuators into closed positions against each respective sleeve during the pressing operation of sleeve surfaces;

a first and second gripping member adjustably positioned exterior of each sleeve for extension against an outer surface of each shoulder seam concurrent with movement of said at least one pair of first and second pressing heads into closed positions against each respective sleeve, said gripping members are extendable by at least one piston being pneumatically extended for positioning each respective gripping member against the outer surface of each shoulder seam during the pressing operation, said gripping members are reciprocatingly retracted by said at least one piston from contact with each shoulder seam upon completion of the pressing operation; and a timing control device for control of a rate of extension of each gripping member against respective outer clothing surfaces proximal of respective shoulder seams, said timing control device in communication with said at least one piston for maintaining each first and second gripping member against respective shoulder seams to maintain tension against respective outer clothing surfaces of each shoulder seam concurrently during the pressing operation for each sleeve, said timing control device controls retraction of said at least one piston for refraction of said gripping members from respective shoulder seams upon completion of the pressing operation.

* * * * *